US005927885A

United States Patent [19]

Duez et al.

[11] Patent Number: 5,927,885

[45] Date of Patent: Jul. 27, 1999

[54] BUFFER RESERVOIR FOR A LIQUID-INK WRITING INSTRUMENT, AND A WRITING INSTRUMENT INCLUDING SUCH A RESERVOIR

[75] Inventors: José Duez, Boulogne sur Mer; Vincent Bedhome, Desvres, both of France

[73] Assignee: Debiotech S.A., Lausanne, Switzerland

[21] Appl. No.: 08/834,172

[22] Filed: Apr. 14, 1997

[30] Foreign Application Priority Data

Apr. 23, 1996 [FR] France ..... 96 05344

[51] Int. Cl.[6] ..... B43K 8/06

[52] U.S. Cl. ..... 401/199; 401/198

[58] Field of Search ..... 401/198, 199

[56] References Cited

U.S. PATENT DOCUMENTS 3,501,225 3/1970 Martin et al. ..... 401/198
5,290,116 3/1994 Chang ..... 401/205 X

FOREIGN PATENT DOCUMENTS 0 516 538 12/1992 European Pat. Off. .
0 726 166 8/1996 European Pat. Off. .
9220530 11/1992 WIPO ..... 401/199

OTHER PUBLICATIONS

*French Search Report* from French application No. 9605344, filed Apr. 23, 1996.
Patent Abstracts of Japan vol. 015, No. 164 (M–1106), Apr. 24, 1991 & JP 03 032896 A Feb. 13.

*Primary Examiner*—Steven A. Bratlie
*Attorney, Agent, or Firm*—Wolf, Greenfield & Sacks, P.C.

[57] ABSTRACT

A buffer reservoir suitable for absorbing surplus ink and a writing instrument including the buffer reservoir are provided. The buffer reservoir includes a mixture of microbeads that are hydrophobic relative to the ink and microbeads that are hydrophilic relative to the ink. The mixture of microbeads may either be uniform throughout the entire volume of the buffer reservoir, or non-uniform throughout the entire volume of the buffer reservoir, with the proportion of hydrophilic microbeads to hydrophobic microbeads being smaller in the zone immediately in contact with the feed tip and larger in the zone farthest away from the feed tip. Preferably, the proportion of hydrophilic microbeads is in the range of about 2% to about 10%, by weight, relative to the total weight of the buffer reservoir. The writing instrument includes a reservoir for liquid ink, a feed tip opening out into the reservoir, and a buffer reservoir.

24 Claims, 2 Drawing Sheets

BUFFER RESERVOIR FOR A LIQUID-INK WRITING INSTRUMENT, AND A WRITING INSTRUMENT INCLUDING SUCH A RESERVOIR

The present invention relates to liquid-ink writing instruments, i.e. writing instruments in which the ink is in the "free" state, i.e. not being held captive in a fiber reservoir. Such a writing instrument includes a reservoir for the ink and a feed tip for feeding the ink by capillarity from the reservoir to the writing head proper which may comprise the end of the feed tip. When the reservoir that contains the ink is not isolated from the air, a variation in conditions of use, and in particular an increase in the pressure of the air contained in the reservoir due to the air heating up, results in an abnormal run in the flow of ink through the feed tip which may give rise to blots or leaks when the top is taken off the instrument. To avoid this phenomenon, provision may be made to equip this type of instrument with a buffer reservoir whose function is to absorb surplus ink coming from the reservoir before it reaches the writing head, i.e. before it reaches the leading end of the feed tip, which end serves as a writing tip, and then, once normal conditions have returned, to return the ink it contains to the feed tip.

BACKGROUND OF THE INVENTION

EP 0 516 538, discloses a writing instrument of that type whose buffer reservoir, which is made of an open-pore hydrophobic material, is made up of at least one compact block that fits snugly around the feed tip and that is coaxial therewith. Preferably, the porous hydrophobic material is based on microbeads or micro-spheres made, for example, of polypropylene.

The buffer reservoir disclosed in EP 0 516 538 is satisfactory from a functional point of view, i.e. technically it fulfills the functions of absorbing the surplus ink arriving in the feed tip when the pressure in the ink reservoir varies, and of subsequently returning the surplus ink to the feed tip. Unfortunately, the effectiveness of the buffer reservoir decreases radially going away from the zone in which the buffer reservoir is in contact with the feed tip. In other words, the ink diffuses easily from the feed tip into the buffer reservoir in a zone that is relatively close to the feed tip, which zone extends over a distance in the range 2 mm to 4 mm depending on the case. The greater the distance from the feed tip, the more difficult ink diffusion becomes, and it becomes reduced to zero at a distance approximately in the range 6 mm to 7 mm.

Given that the function of the buffer reservoir is to be capable of absorbing surplus ink due to a variation in the pressure in the ink reservoir, it will be understood that the working volume of the buffer reservoir is a function of the maximum volume of surplus ink that might result from such a variation. The volume of surplus ink is a function, in particular, of the volume of air contained in the liquid-ink reservoir, since it is generally an increase in the temperature of the air contained in said liquid-ink reservoir that causes the pressure variation which results in the surplus ink in the feed tip. The smaller the amount of ink remaining in the reservoir, the larger the amount of air contained therein, and the larger the amount of surplus ink for the same increase in temperature.

The problem that has been observed currently leads either to a buffer reservoir being provided that is very long, i.e. that has a large surface area over which it is in contact with the feed tip, or to the capacity of the liquid-ink reservoir being limited.

OBJECTS AND SUMMARY OF THE INVENTION

An object of the invention is to provide a buffer reservoir that mitigates the above-mentioned drawback.

This object is achieved by the buffer reservoir of the invention, which buffer reservoir is, in the manner disclosed in EP 0 516 538, a buffer reservoir for a writing instrument containing a liquid ink, including a reservoir for the liquid ink, and a feed tip opening out in the reservoir, the buffer reservoir being suitable for absorbing the surplus ink in the event that the pressure in the reservoir varies and for subsequently returning it, and being implemented in the form of a compact block made of an open-pore material based on microbeads.

In characteristic manner, according to the invention, the buffer reservoir is made up of microbeads that are hydrophobic relative to the ink and a small proportion of microbeads that are hydrophilic relative to the ink.

In the present text, the notions of being hydrophilic or hydrophobic are relative notions relating to the type of the ink, in particular its viscosity and its surface tension. A porous material through which a given ink diffuses naturally under normal conditions of use is considered to be hydrophilic relative to that ink—and even when the ink does not have water as a solvent. A porous material through which the same given ink does not diffuse under normal conditions of use is considered to be hydrophobic relative thereto. A given material may be hydrophobic for a given ink and hydrophilic for another ink. For example, polypropylene is hydrophobic for an aqueous ink without any additive capable of modifying its surface tension, and hydrophilic for an ink of the type having alcohol as a solvent. However, the principle of the buffer reservoir is that surplus ink can diffuse through the hydrophobic material when conditions of use are modified, in particular by an abnormal increase in pressure.

Unexpectedly, the presence of a small proportion of hydrophilic microbeads among the hydrophobic microbeads facilitates diffusion of the ink throughout the entire volume of the buffer reservoir, well beyond the peripheral zone which is in direct contact with the ink, in particular at the surface of the feed tip.

It is believed that it is difficult for the ink to diffuse through the mesh made up of the hydrophobic microbeads of the buffer reservoir because of the headloss that increases with increasing radial distance from the periphery of the feed tip. Locally disposing hydrophilic microbeads on the path followed by the ink through the mesh of hydrophobic microbeads enables the ink to reach hydrophobic sites which would be inaccessible in the case of a buffer reservoir made exclusively of hydrophobic microbeads.

The presence of hydrophobic and hydrophilic microbeads may result in a mixture that is uniform throughout the entire volume of the buffer reservoir.

It may also be a non-uniform mixture, the proportion of hydrophilic microbeads being smaller in the zone immediately in contact with the surplus ink, and being larger in the zone that is furthest away therefrom.

On average, the proportion of hydrophilic microbeads lies in the range 2% to 10% relative to the total weight of the buffer reservoir.

In a preferred embodiment, the mixture is a uniform mixture, 95% of which is made up of hydrophobic microbeads, and 5% of which is made up of hydrophilic microbeads.

BRIEF DESCRIPTION OF THE DRAWING

The present invention will be better understood on reading the following description of an embodiment of a liquid-ink writing instrument including a buffer reservoir composed of hydrophobic microbeads and a small proportion of hydrophilic microbeads, shown in the accompanying drawing, in which.

DETAILED DESCRIPTION

Figure 1:
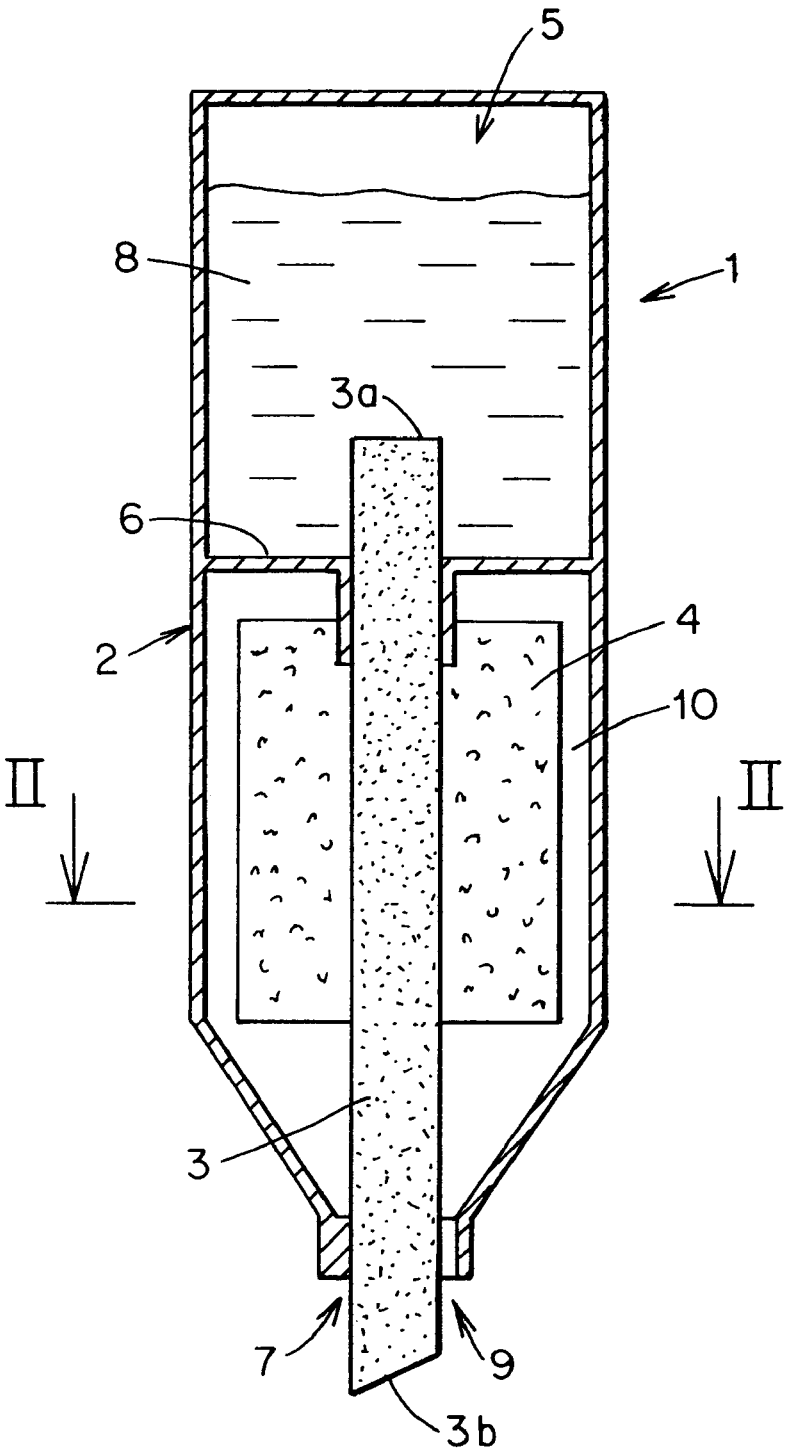
FIG. 1 is a diagrammatic view in longitudinal section through a writing instrument.

The writing instrument 1 shown in FIG. 1 includes a body 2, a feed tip 3, and a buffer reservoir 4. The rear portion of the body 2 constitutes a reservoir 5 for liquid ink, which reservoir is closed by an internal partition 6. The trailing end 3*a* of the feed tip 3 penetrates into the reservoir 5 via the internal partition 6; its leading end 3*b* constitutes the writing tip and extends outside the body 2 via a central orifice 7. The buffer reservoir 4 is suitable for absorbing the surplus ink coming from the feed tip 3 by capillarity when the pressure in the ink reservoir 5 varies, and for subsequently returning the surplus ink to the feed tip. The buffer reservoir is made of a material having open pores and based on microbeads, and it is in the form of a compact block fitting snugly around the feed tip 3 and coaxial therewith.

In such a writing instrument 1, the ink 8 coming from the reservoir 5 is consumed by the writing tip 3*b* as the writing instrument is used, and it is replaced by air which can flow freely between the surroundings and the reservoir 5 because of the natural porosity of the feed tip 3 but also because a communication orifice 9 is provided at the central orifice 7 via which the writing tip 3*b* passes and because there is an empty space 10 surrounding the buffer reservoir 4. The buffer reservoir 4 is a porous compact block based on microbeads whose grade, grain-size, distribution, molecular weight, and morphology are known. The compact block may be obtained by heat-fusing a mixture of microbeads of at least two thermoplastics materials of different grades, i.e. two materials having different melting points. Once the microbeads have been mixed uniformly in a suitable mold, they are heated to a given temperature that is higher than the melting point of the material of the first type and lower than the melting point of the material of the second type. In this way, the material of the microbeads of the first type melts, thereby firstly creating micro-cavities corresponding to the open pores, and secondly bonding together all of the microbeads of the materials of the second type.

This embodiment is not limiting. In particular, the compact block may be obtained using microbeads of a single thermoplastics material merely by sintering, the capillary mesh comprising the interstices between the microbeads, after they have been locally fused and stuck together.

Under normal conditions of use, the ink 8 which is contained in the reservoir 5 and which is in contact with the trailing end 3*a* of the feed tip 3 is absorbed and migrates by capillarity into the feed tip 3 until it reaches the leading end 3*b* thereof. The ink consumed by the leading end 3*b* serving as a writing head is replaced as it is consumed with ink 8 coming from the reservoir 5. In the reservoir 5, the ink which diffuses into the feed tip 3 is itself replaced by air coming from the inside of the body 2. Pressure equilibrium is thus established between the air contained in the reservoir 5 and the air contained in the remainder of the body 2.

Under abnormal conditions of use, due in particular to an increase in pressure in the reservoir 5, e.g. when the instrument 1 heats up, surplus ink 8 flows from the reservoir 5 into the feed tip 3. Because of the presence of the buffer reservoir 4, the surplus ink does not reach the writing tip 3*b*. By capillarity, the surplus ink diffuses into the buffer reservoir 4 in contact with the capillary tubes of the feed tip 3 until the pressure balance is re-established. Then, on re-using the instrument 1, the ink consumed by the writing head 3*b* comes preferentially from the buffer reservoir 4.

The buffer reservoir 4 must be capable of accommodating all of the surplus ink that might flow from the feed tip 3 in the event of an abnormal increase in the pressure inside the reservoir 5. This storage capacity is a function of the capacity of the reservoir 5 of liquid ink 8, the surplus being at its maximum when the ink reservoir contains a large proportion of air which tends to expand considerably in the event that the temperature of the instrument 1 increases.

Given the proportion of air in the porous compact block including the buffer reservoir 4, it is theoretically possible to perform calculations to define the ideal volume necessary for the buffer reservoir of a given writing instrument.

It has been observed that, depending on the configuration of the buffer reservoir 4, the ideal volume is not always sufficient to absorb all of the surplus ink insofar as the buffer reservoir does not always saturate fully since the ink is unable to diffuse radially beyond a certain distance from the face that is in contact with the feed tip 3. This distance is a function of the type of the ink 8, in particular its surface tension and its viscosity, and also of the structure of the buffer reservoir 4. In certain cases, the distance that is effective, i.e. the distance over which the buffer reservoir is saturated, can be limited to in the range 2 mm to 3 mm.

Admittedly, to solve this problem, it would be possible to increase the surface area of the buffer reservoir 4 that is in immediate contact with the ink. However, that would make it necessary to modify the structure of the reservoir 4, e.g. by increasing its length for a determined ideal volume. Such a modification in structure would require the configuration of the instrument to be modified accordingly.

The invention solves the above-mentioned problem by making up the buffer reservoir 4 from microbeads by using hydrophobic microbeads and a small proportion of hydrophilic microbeads, where the concepts of 'hydrophobic' and 'hydrophilic' are to be understood in accordance with the particular definition given above.

The presence of the small proportion of hydrophilic microbeads facilitates diffusion of the ink throughout the entire volume of the buffer reservoir.

With polyethylene microbeads having a mean diameter lying in the range 25 $\mu$m to 250 $\mu$m, the proportion of hydrophilic polyethylene suitable for achieving the above technical effect lies in the range 2% to 10% of all of the microbeads making up the buffer reservoir.

To make the buffer reservoir 4, the majority of the microbeads that are used are hydrophobic, and a small proportion of them are hydrophilic. The microbeads are caused to be hydrophobic or hydrophilic as a function of the type of ink used either by appropriately choosing the materials from which they are made, or by appropriately pretreating them, e.g. by treating them with fluorine-containing plasma to make them hydrophobic or subjecting them to oxidation treatment to make them hydrophilic, or by depositing a surface-active agent to bring the surface energy of the material to a value determined as a function of the desired property, i.e. the hydrophilic property or the hydrophobic property.

In one embodiment, the hydrophobic microbeads and the hydrophilic microbeads are mixed uniformly throughout the entire volume of the buffer reservoir. In a particular example, in which an aqueous ink and polyethylene microbeads were used having a mean diameter of about 140 $\mu$m, the mixture contained 95% of hydrophobic microbeads and 5% of hydrophilic microbeads. The buffer reservoir was cylindrical in shape and about 12.5 mm in diameter, and the feed tip disposed axially in the buffer reservoir had a diameter of about 5 mm. By cyclically raising the temperature of the instrument to temperatures as high as in the range 50° C. to 55° C. during use, the entire volume of the buffer reservoir was fully saturated at the end of a cycle when the ink reservoir 5 was almost empty.

It should be emphasized that if the proportion of hydrophilic microbeads is increased, the buffer reservoir behaves as if it were made of an entirely hydrophilic material. In other words, the ink diffuses through the material in question even if the conditions of use are normal conditions. Clearly, this is not the technical function that is desired for a buffer reservoir. The buffer reservoir must absorb and return the surplus ink resulting from abnormal conditions of use, and should not act as storage means in which ink is stored in addition to the liquid-ink reservoir.

The maximum percentage for microbeads that enable the desired effect of improving ink migration to be obtained was about 10%. This proportion can change as a function of the type of the ink, and of the type and size of the microbeads. It must therefore be left to a person skilled in the art to determine accurately, as a function of these parameters, the optimum proportion to be chosen for the hydrophilic microbeads relative to all of the microbeads used to make up the buffer reservoir.

As emphasized above, the diffusion of the ink 8 from the face in contact with the feed tip 3 is slowed down because of the existence of headloss in the capillary mesh of the buffer reservoir 4. However, the diffusion is very good in the zone immediately in contact with the ink. Therefore, in said zone, it would be possible to use hydrophobic microbeads only, or optionally an even smaller proportion of hydrophilic microbeads. In other words, it would be possible to cause the proportion of hydrophilic microbeads to vary continuously or discontinuously from the zone immediately in contact with the ink to the zone that is furthest away from it. When such variation is discontinuous, the buffer reservoir can then be in the form of annular elements nesting inside one another, the outer annular element having the highest proportion of hydrophilic microbeads.

Figure 2:
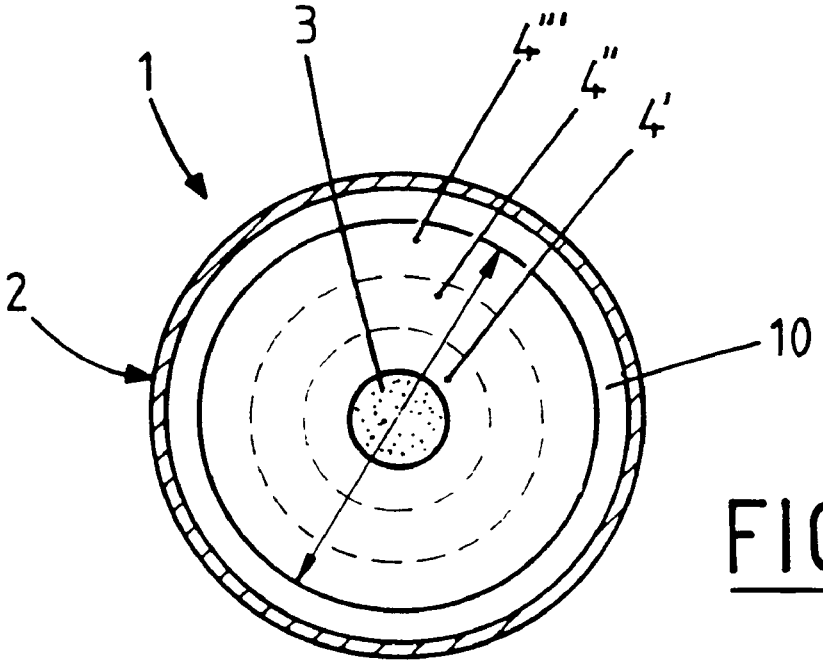
FIG. 2 is a diagrammatic view in cross-section on line II.II of FIG. 1.

FIG. 2 shows a buffer reservoir 4 which was made up of three successive elements 4', 4", 4''' nested in one another and in which the proportion of hydrophilic microbeads was respectively 2% for the innermost element 4', 6% for the intermediate element 4", and 10% for the outermost element 4'''.

The present invention is not limited to the embodiment described above by way of non-exhaustive example. In particular, the choice of the microbeads involved in the composition of the buffer reservoir is determined as a function of the desired properties. They may be made of polyethylene as in the above-mentioned example, or they may be made of other materials such as, in particular, polypropylene. The hydrophilic microbeads may be made of a material that is different from the material of the hydrophobic microbeads.

In addition, it may be advantageous to choose microbeads having different dimensions or even different grades for the hydrophobic microbeads and/or for the hydrophilic microbeads. Such differences in dimensions and also the differences in melting point, if the grades are different, affect the capillary properties of the resulting buffer reservoir. The wide variety of parameters that can be involved in implementing the buffer reservoir widens the possibilities offered to a person skilled in the art.

We claim:

1. A buffer reservoir for a writing instrument containing a liquid ink, comprising:

the form of a compact block made of an open-pore material based on microbeads, wherein a first portion of said microbeads is hydrophobic relative to said ink and a second portion of said microbeads is hydrophilic relative to said ink.

2. A buffer reservoir according to claim 1, wherein said microbeads that are hydrophobic relative to said ink and said microbeads that are hydrophilic relative to said ink are distributed in a uniform mixture throughout the entire volume of said buffer reservoir.

3. A buffer reservoir according to claim 1, wherein said microbeads are distributed in a non-uniform mixture, such that said portion of microbeads that are hydrophilic relative to said ink is relatively smaller than the portion of microbeads that are hydrophobic to said ink in a zone immediately in contact with a feed tip, and is larger in a zone that is furthest away therefrom.

4. A buffer reservoir according to claim 3, further comprising annular elements nesting in one another, wherein said portion of microbeads that are hydrophilic relative to said ink is smallest in an annular element that is immediately in contact with said feed tip, and is largest in another annular element that is furthest away therefrom.

5. A buffer reservoir according to claim 1, wherein said portion of microbeads that are hydrophilic relative to said ink lies in a range of about 2% to about 10% relative to the total weight of said buffer reservoir.

6. A buffer reservoir according to claim 2, wherein about 95% of the uniform mixture comprises microbeads that are hydrophobic relative to said ink, and about 5% of said uniform mixture comprises microbeads that are hydrophilic relative to said ink.

7. A buffer reservoir according to claim 1, wherein said microbeads that are hydrophilic relative to said ink comprise a different material than said microbeads that are hydrophobic relative to said ink.

8. A buffer reservoir according to claim 1, wherein said microbeads that are hydrophilic relative to said ink comprise different dimensions than said microbeads that are hydrophobic relative to said ink.

9. A buffer reservoir according to claim 1, wherein said microbeads that are hydrophilic relative to said ink comprise a different melting point than said microbeads that are hydrophobic relative to said ink.

10. A buffer reservoir according to claim 1 wherein said microbeads that are hydrophilic relative to said ink comprise a different material and different dimensions than said microbeads that are hydrophobic relative to said ink.

11. A buffer reservoir according to claim 1, wherein said microbeads that are hydrophilic relative to said ink comprise a different material and a different melting point than said microbeads that are hydrophobic relative to said ink.

12. A buffer reservoir according to claim 1, wherein said microbeads that are hydrophilic relative to said ink comprise different dimensions and a different melting point than said microbeads that are hydrophobic relative to said ink.

13. A writing instrument comprising:

a buffer reservoir;

a reservoir for a liquid ink; and a feed tip opening out into the reservoir;

wherein said buffer reservoir is constructed and arranged to absorb surplus ink from said ink reservoir and to return surplus ink to said ink reservoir, said buffer reservoir comprising microbeads, wherein a portion of said microbeads are hydrophobic relative to said liquid ink and another portion of said microbeads are hydrophilic relative to said liquid ink, said buffer reservoir fitting snugly around said feed tip and being coaxial therewith.

14. The writing instrument of claim 13, wherein said microbeads that are hydrophobic relative to said ink and said microbeads that are hydrophilic relative to said ink are distributed in a uniform mixture throughout the entire volume of said buffer reservoir.

15. The writing instrument of claim 13, wherein said microbeads are distributed in a non-uniform mixture throughout the entire volume of said buffer reservoir, such that said portion of microbeads that are hydrophilic relative to said ink is smaller in a zone immediately in contact with said feed tip, and is larger in a zone that is furthest away therefrom.

16. The writing instrument of claim 13, further comprising annular elements nesting in one another, wherein said portion of microbeads that are hydrophilic relative to said ink is smallest in an annular element that is immediately in contact with said feed tip, and is largest in another annular element that is furthest away therefrom.

17. The writing instrument of claim 13, wherein said portion of microbeads that are hydrophilic relative to said ink lies in the range of about 2% to about 10% relative to the total weight of said buffer reservoir.

18. The writing instrument of claim 13, wherein about 95% of the mixture comprises microbeads that are hydrophobic relative to said ink, and about 5% of said mixture comprises microbeads that are hydrophilic relative to said ink.

19. The writing instrument of claim 13, wherein said microbeads that are hydrophilic relative to said ink comprise different dimensions than said microbeads that are hydrophobic relative to said ink.

20. The writing instrument of claim 13, wherein said microbeads that are hydrophilic relative to said ink comprise a different melting point than said microbeads that are hydrophobic relative to said ink.

21. The writing instrument of claim 13, wherein said microbeads that are hydrophilic relative to said ink comprise a different material and different dimensions than said microbeads that are hydrophobic relative to said ink.

22. The writing instrument of claim 13, wherein said microbeads that are hydrophilic relative to said ink comprise a different material and a different melting point than said microbeads that are hydrophobic relative to said ink.

23. The writing instrument of claim 13, wherein said microbeads that are hydrophilic relative to said ink comprise a different dimension and a different melting point than said microbeads that are hydrophobic relative to said ink.

24. The writing instrument of claim 13, wherein said microbeads that are hydrophilic relative to said ink comprise a different material and different dimensions than said microbeads that are hydrophobic relative to said ink.

* * * * *

UNITED STATES PATENT AND TRADEMARK OFFICE

CERTIFICATE OF CORRECTION

PATENT NO. : 5,927,885
DATED : July 27, 1999
INVENTOR(S) : Duez et al.

It is certified that error appears in the above-identified patent and that said Letters Patent is hereby corrected as shown below:

Item [73] Assignee: Change "Debiotech S.A., Lausanne, Switzerland" to -- CONTE S.A., Sur Mer, France --.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*